US009596898B2

(12) United States Patent
Seawright

(10) Patent No.: US 9,596,898 B2
(45) Date of Patent: Mar. 21, 2017

(54) BRAIDLESS APPARATUS AND METHOD OF COMBINING NATURAL AND ARTIFICIAL HAIR

(71) Applicant: Shangrila Seawright, Davenport, IA (US)

(72) Inventor: Shangrila Seawright, Davenport, IA (US)

( * ) Notice: Subject to any disclaimer, the term of this patent is extended or adjusted under 35 U.S.C. 154(b) by 50 days.

(21) Appl. No.: 14/625,128

(22) Filed: Feb. 18, 2015

(65) Prior Publication Data

US 2016/0235149 A1 Aug. 18, 2016

(51) Int. Cl.
*A41G 3/00* (2006.01)
*A41G 5/00* (2006.01)

(52) U.S. Cl.
CPC ..... *A41G 5/006* (2013.01)

(58) Field of Classification Search
CPC ..... A41G 5/00; A41G 5/004; A41G 5/0053; A41G 5/006; A41G 5/0066; A41G 5/0073; A41G 5/008; A41G 5/0086
See application file for complete search history.

(56) References Cited

U.S. PATENT DOCUMENTS 2,865,380 A * 12/1958 Mitchell ..... A41G 5/006 132/201
4,049,006 A 9/1977 Saunders et al.
4,372,330 A * 2/1983 Nelson ..... A41G 5/002 132/201
5,121,761 A * 6/1992 Meister ..... A41G 5/0053 132/201
5,357,986 A 10/1994 Hargrett
5,518,011 A 5/1996 Nash
5,740,819 A 4/1998 Hicks
7,992,576 B2 8/2011 Chang
8,360,075 B2 1/2013 Winn
2006/0180171 A1 8/2006 Kim
2008/0236605 A1 10/2008 Russo
2012/0067365 A1 3/2012 Brown
2014/0034077 A1 2/2014 Burchard

* cited by examiner

*Primary Examiner* — Rachel Steitz
(74) *Attorney, Agent, or Firm* — Dale J. Ream

(57) ABSTRACT

A method for forming a combination of natural and artificial hair on a person's head without a braid foundation includes the steps of providing a wefted hair extension having artificial hair, a sew-in needle and a thread pair extending therefrom. The method includes parting the person's natural hair so as to form a plurality of adjacent hair root sections forming a starter knot about a starter root section by looping the thread pair about the starter root section using the sew-in needle. A foundation is created laterally across a person's head along the part line by repeatedly looping the thread pair around respective hair root sections between the starter and ending root sections. Then, the wefted hair extension is sewn to the foundation track using the sew-in needle and the thread pair so as to form a combination of natural and artificial hair extending from the person's head.

12 Claims, 14 Drawing Sheets

BRAIDLESS APPARATUS AND METHOD OF COMBINING NATURAL AND ARTIFICIAL HAIR

BACKGROUND OF THE INVENTION

This invention relates generally to a method for attaching a hair extension to a person's head and, more particularly, to a method of combining a person's natural hair with an artificial hair extension without a braided foundation.

Women often desire to attach extensions of artificial hair to their own natural hair in order to give the appearance of a fuller head of hair, a longer section of hair, or perhaps just another color of hair. Hair extensions, of course, must be attached or "anchored" to either a person's head or to her natural hair. Traditionally, a person's natural hair has been prepared by forming a horizontal braided section or a similar anchoring base. Then, the hair extension may be sewn to the braid or other anchor with a needle and thread. In fact, it would be unexpected to transform natural hair into a combination of natural and artificial hair without including first forming a braded foundation.

Although assumably effective for their intended purposes, the existing devices and methods for attaching hair extensions are complicated, require time consuming preparation of the hair (e.g. forming a braid), or require an undesirable amount of hardware. Therefore, it would be desirable to have a method of transforming a person's natural hair into a combination of natural and artificial hair that does not require a braided foundation or complicated hardware. Further, it would be desirable to have a method for transforming hair that utilizes a sew-in needle, a thread-pair, and steps of looping the thread around adjacent hair root sections of parted natural to form a foundation track to which to sew-in a hair extension.

SUMMARY OF THE INVENTION

A method for forming a combination of natural and artificial hair on a person's head without a braid foundation according to the present invention includes the steps of providing a wefted hair extension that includes artificial hair and includes a sew-in needle and a thread pair extending from the rear of the needle. The method includes parting the person's natural hair so as to form a plurality of hair root sections contiguously adjacent one another along a part line and then forming a starter knot about a starter root section selected from the plurality of hair root sections by looping the thread pair about the starter root section using the sew-in needle. A foundation track is created laterally across a person's head along the part line by repeatedly looping the thread pair around respective hair root sections between the starter root section and an ending root section. Then the wefted hair extension is sewn to the foundation track using the sew-in needle and the thread pair so as to form a combination of natural and artificial hair extending from the person's head.

Therefore, a general object of this invention is to provide a method for transforming a person's natural hair into a combination of natural hair and artificial hair.

Another object of this invention is to provide a method for transforming hair, as aforesaid, that combines natural and artificial hair without first having or installing a braid foundation.

Still another object of this invention is to provide a method for transforming hair, as aforesaid, that includes parting a person's hair to form a plurality of hair root sections.

Yet another object of this invention is to provide a method for transforming hair, as aforesaid, that includes using a needle and a thread pair to repeatedly loop around adjacent hair root sections to form a braidless foundation track.

A further object of this invention is to provide a method for transforming hair, as aforesaid, to sew-in a weft of artificial hair to the foundation track.

A still further object of this invention is to provide a method for transforming hair, as aforesaid, that includes forming auxiliary knots by routing the needle and thread pair through the threads of the thread pair.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A method for transforming a person's natural hair into a combination of natural hair and artificial hair will now be described with reference to FIGS. 1 to 12 of the accompanying drawings. First, the method provides a sew-in needle 10, a thread pair 12 coupled to and extending away from the sew-in needle 10, and wefted hair extension 14 having an appearance indicative of natural hair. Preferably, the thread is of a silk construction that is slip resistant.

Figure 1:
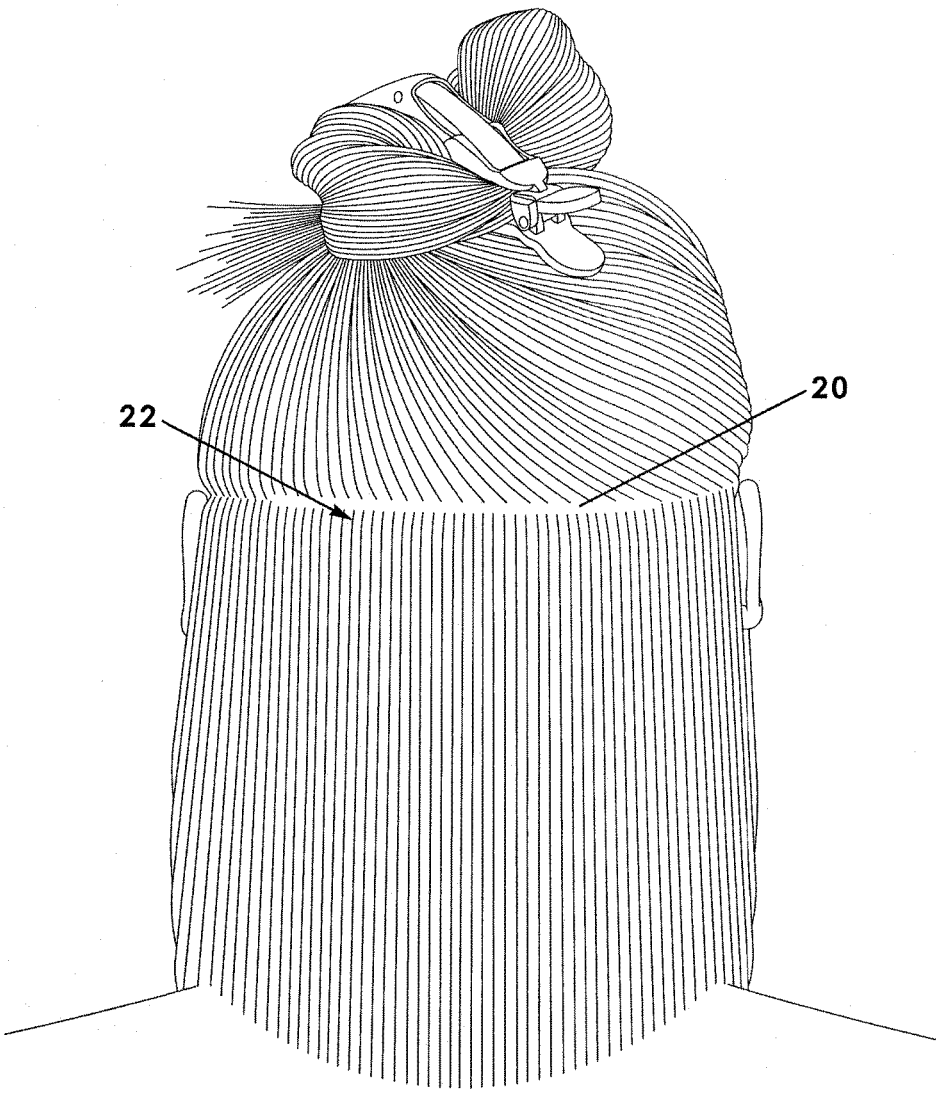
FIG. 1 is a rear view of a person's natural hair parted in conjunction with a method for transforming a person's natural hair into a combination of natural and artificial hair according to an embodiment of the present invention.
Figure 2:
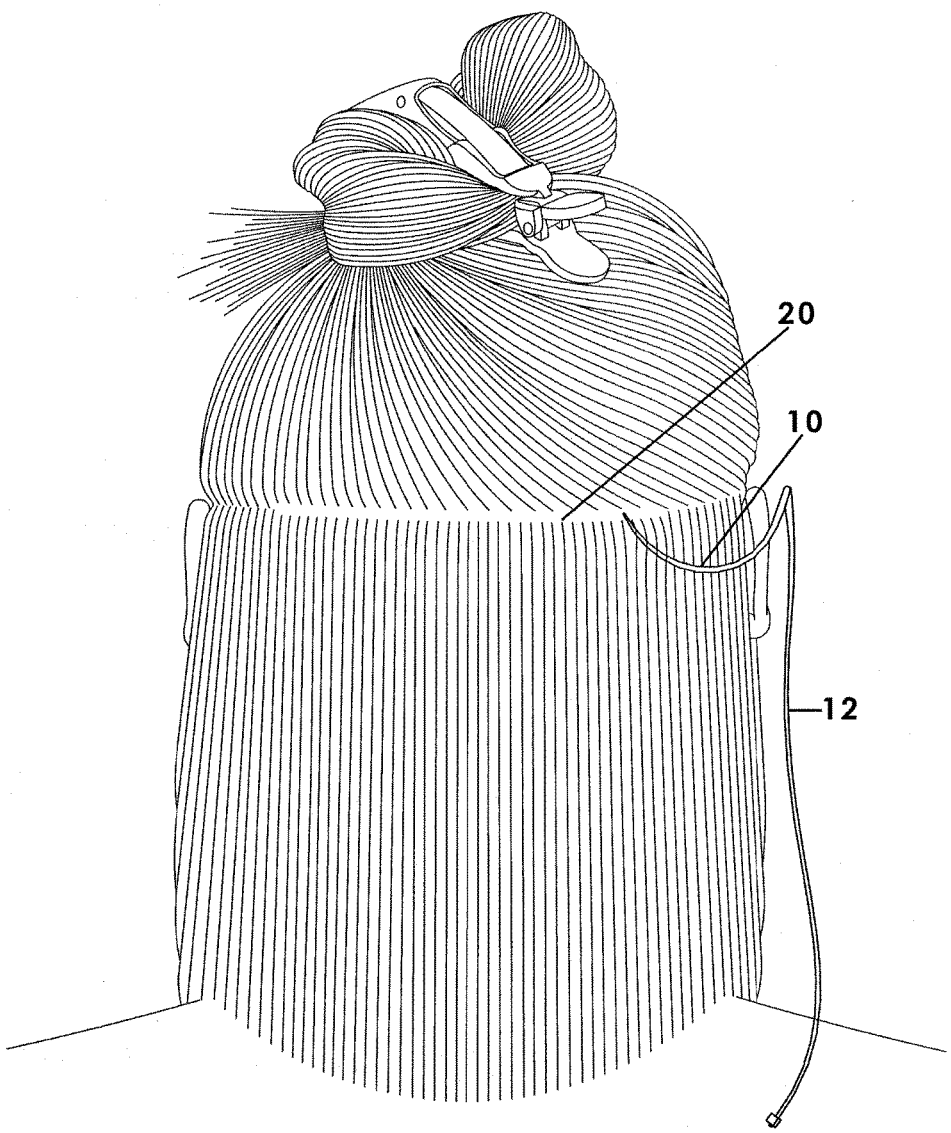
FIG. 2 is a rear view as in FIG. 1 with a sew-in needle ready for use in the method according to the present invention.
Figure 9:
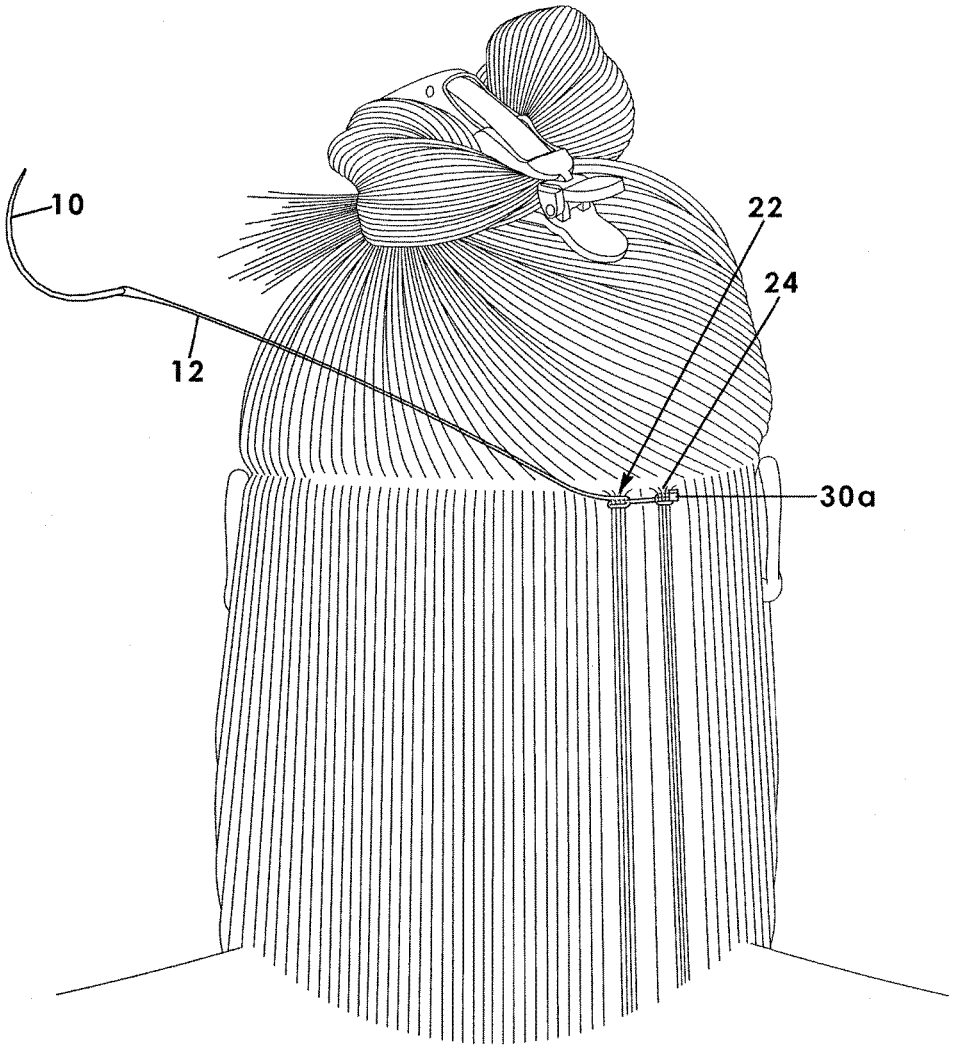
FIG. 9 is a rear view as in FIG. 6 illustrating completing the auxiliary knot.

A person's natural hair is prepared for attachment to the hair extension 14. More particularly, the natural hair is parted, such as horizontally, so as to form a plurality of hair root sections extending adjacent one another along a part line. In other words, one portion of a person's natural hair is directed in one direction while an adjacent portion of a person's natural hair is directed in an opposing direction such that a line of scalp is revealed and not covered by either portion of directed hair (FIG. 1). When parted, a plurality of hair root sections 22 is revealed from which strands of hair extend (FIG. 9). This space between the two hair portions may be referred to as a part line 20.

Figure 3:
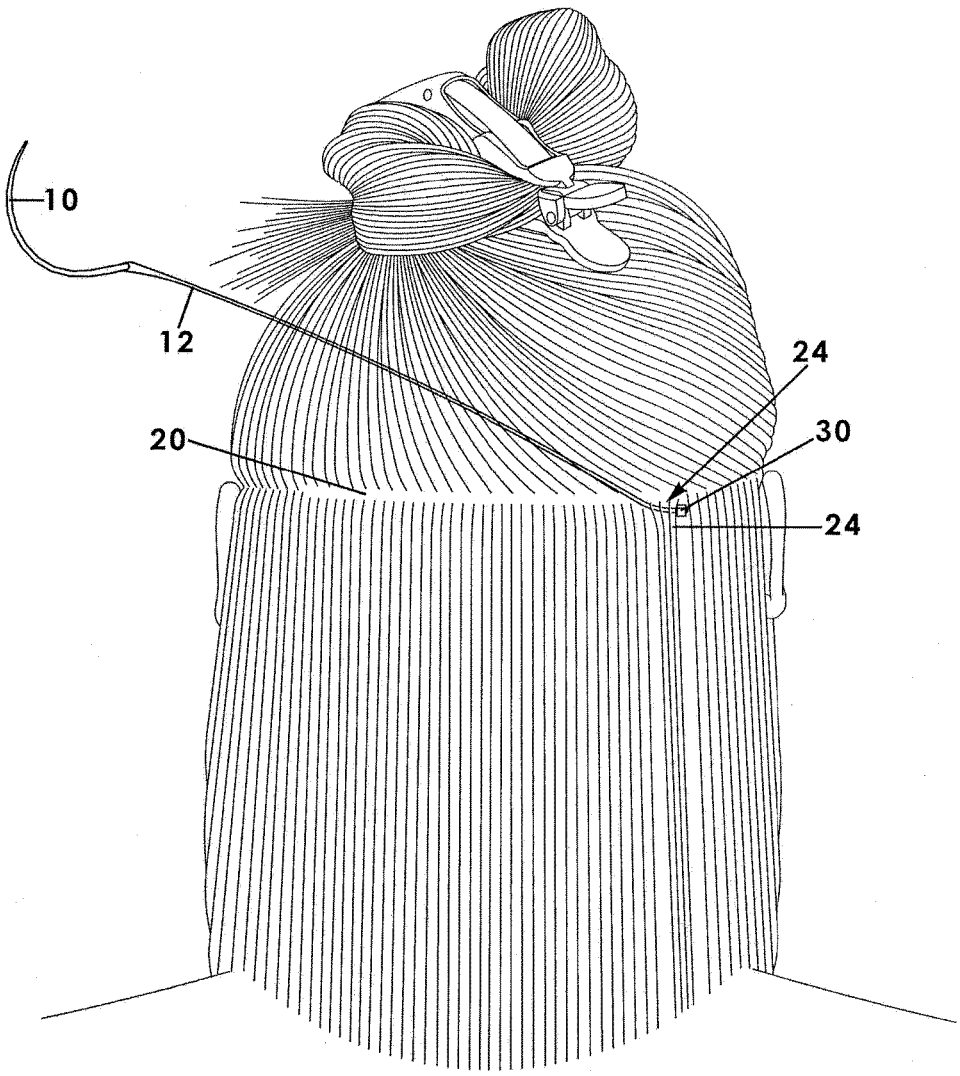
FIG. 3 is a rear view as in FIG. 1 with the sew-in needle in use forming a starter knot about a starter root section.
Figure 4A:
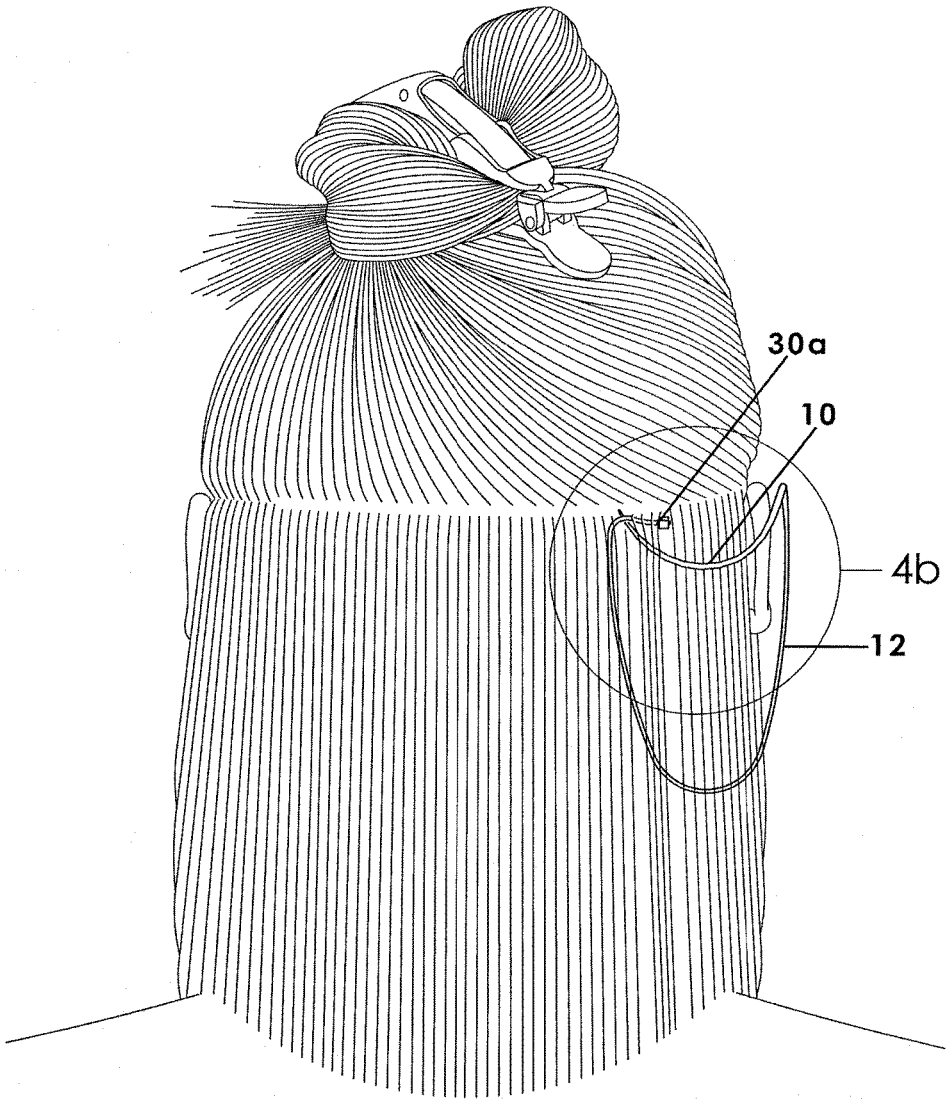
FIG. 4*a* is a rear view as in FIG. 1 with the sew-in needle in further use forming the starter knot knot.
Figure 4B:
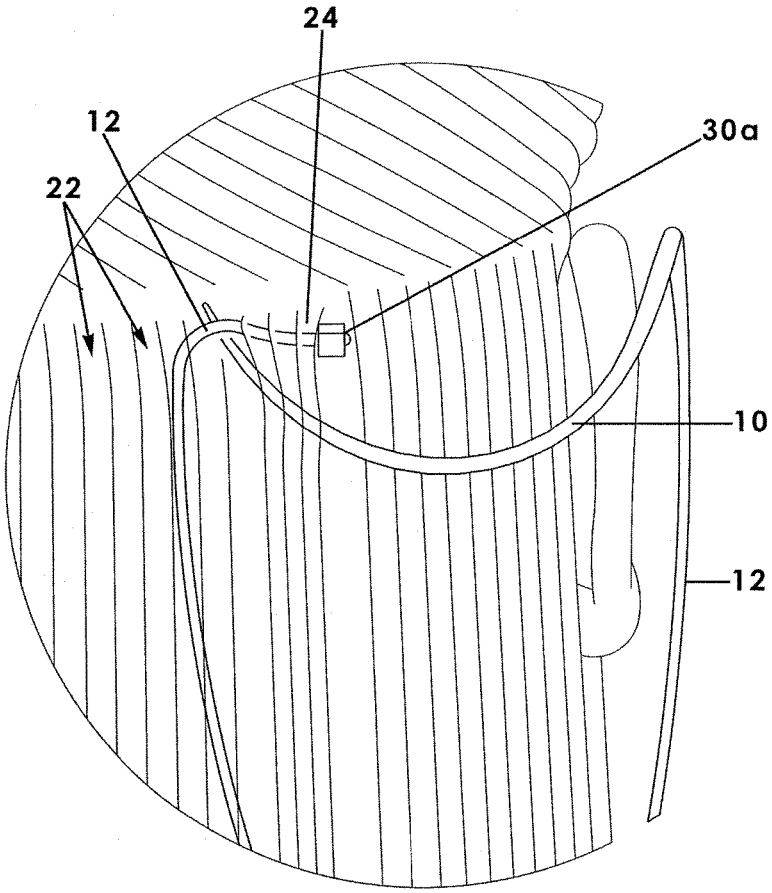
FIG. 4*b* is an isolated view on an enlarged scale taken from FIG. 4*a;*
Figure 5:
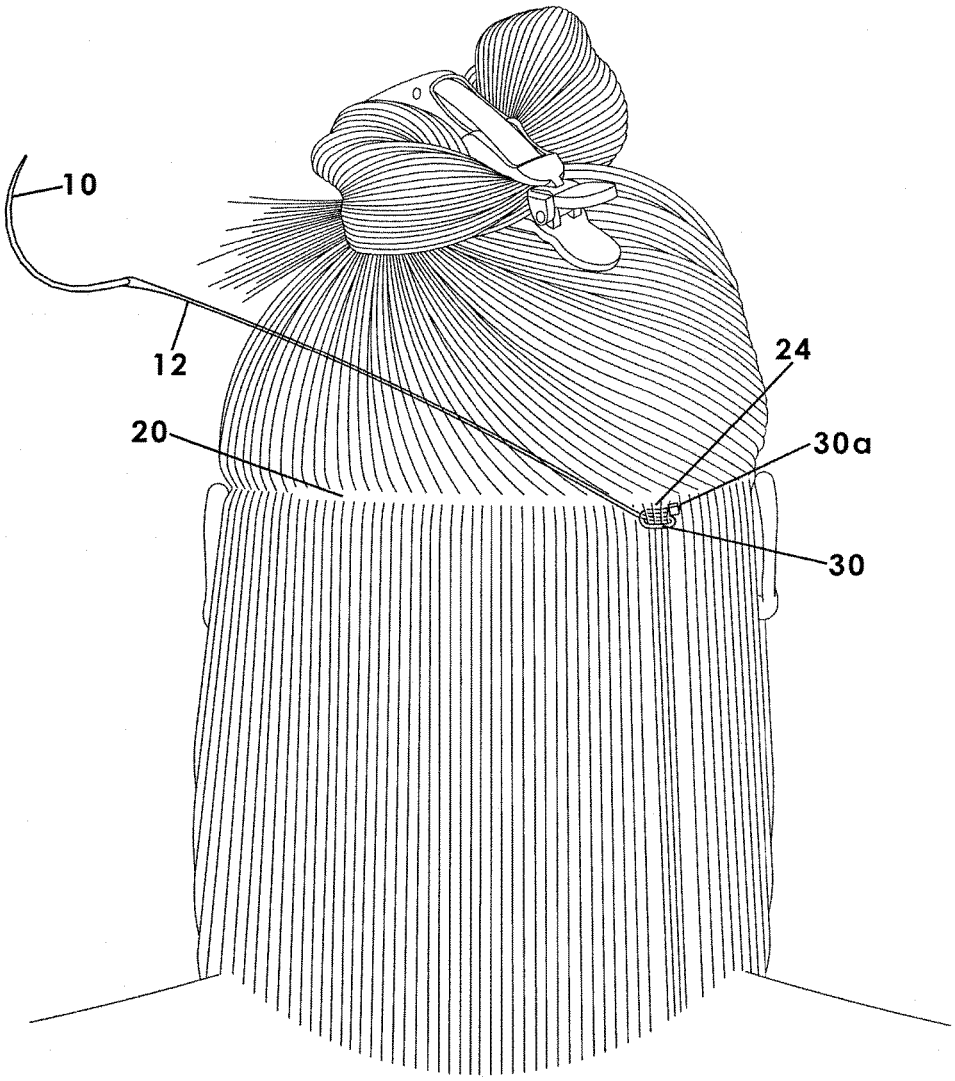
FIG. 5 is a rear view as in FIG. 3 with the sew-in needle in use completing and tightening a starter knot.
Figure 6:
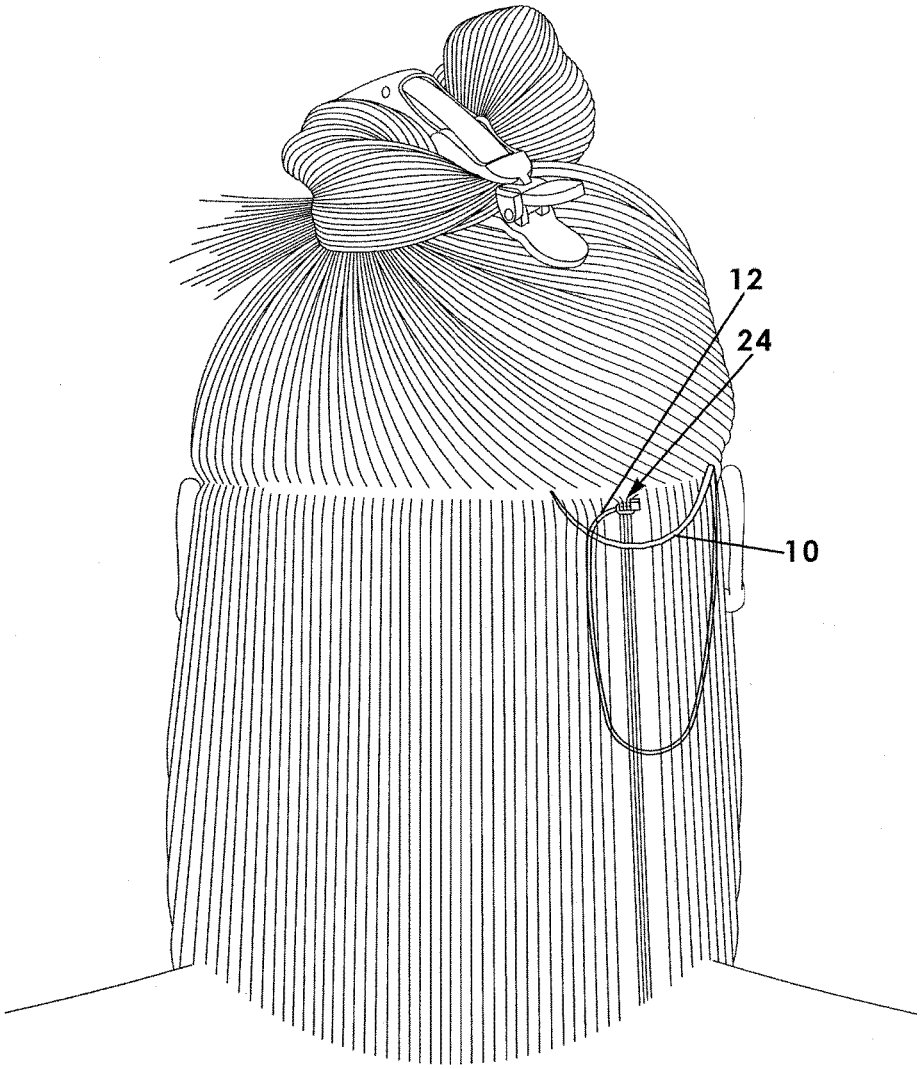
FIG. 6 is a rear view as in FIG. 1 with the sew-in needle completing the starter knot.
Figure 7:
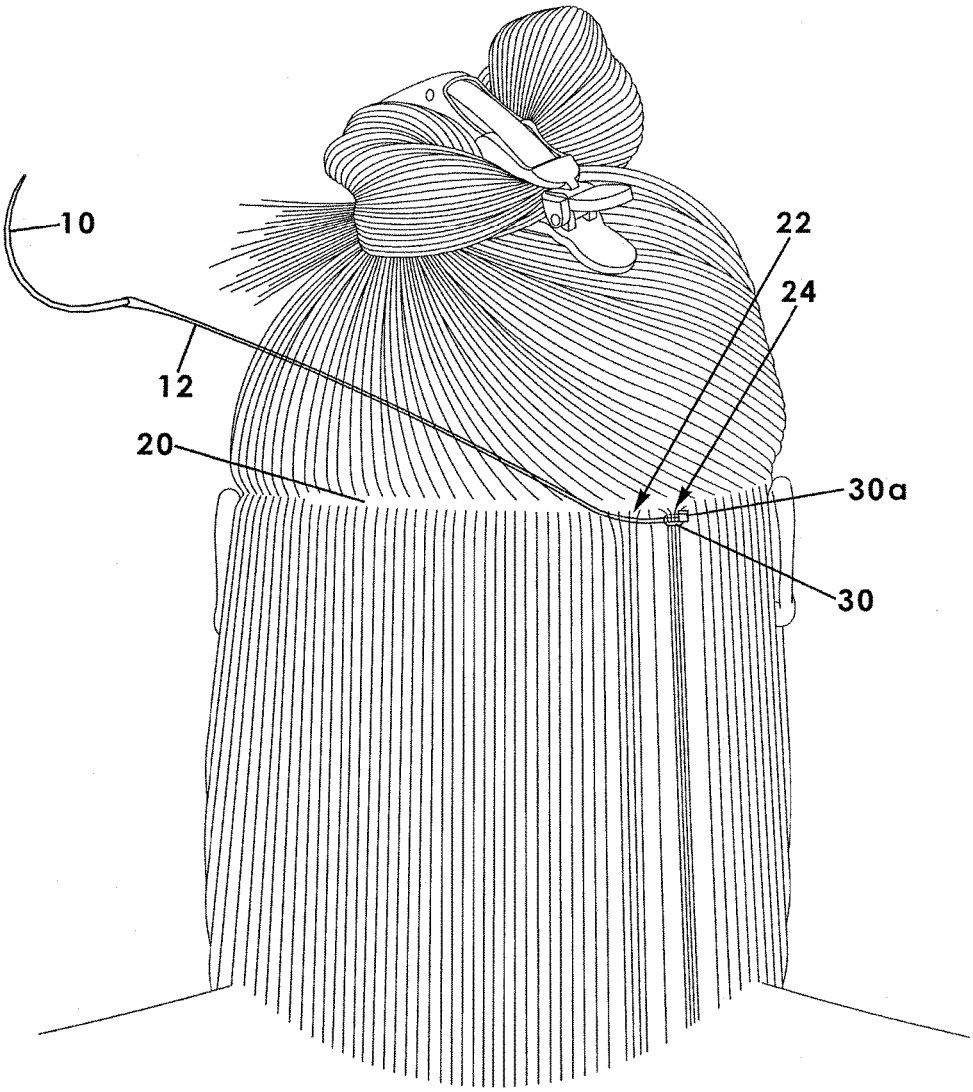
FIG. 7 is a rear view as in FIG. 1 with the sew-in needle starting to loop about a next adjacent hair root section.

According to the method, a starter knot 30 is formed about a starter root section, the starter root section being selected from the plurality of hair root sections 22. Specifically, the starter knot 30 is formed by extending the sew-in needle 10 behind and then around the starter root section 24, thereby looping the thread pair 12 around the starter root section 24 as shown in FIG. 3. The sew-in needle 10 may then be directed beneath the thread pair 12 adjacent the starter root section 24 and pulled tight so as to form the starter knot 30 (FIGS. 4*a* and 4*b*). The steps of looping the thread pair 12 about the starter root section 24 and forming the starter knot 30 may be repeated to strength the starter knot 30 and avoid it unraveling. In an embodiment, the starter knot 30 may include a start anchor link 30*a* or bead to prevent unraveling as will be described in more detail later.

Figure 10:
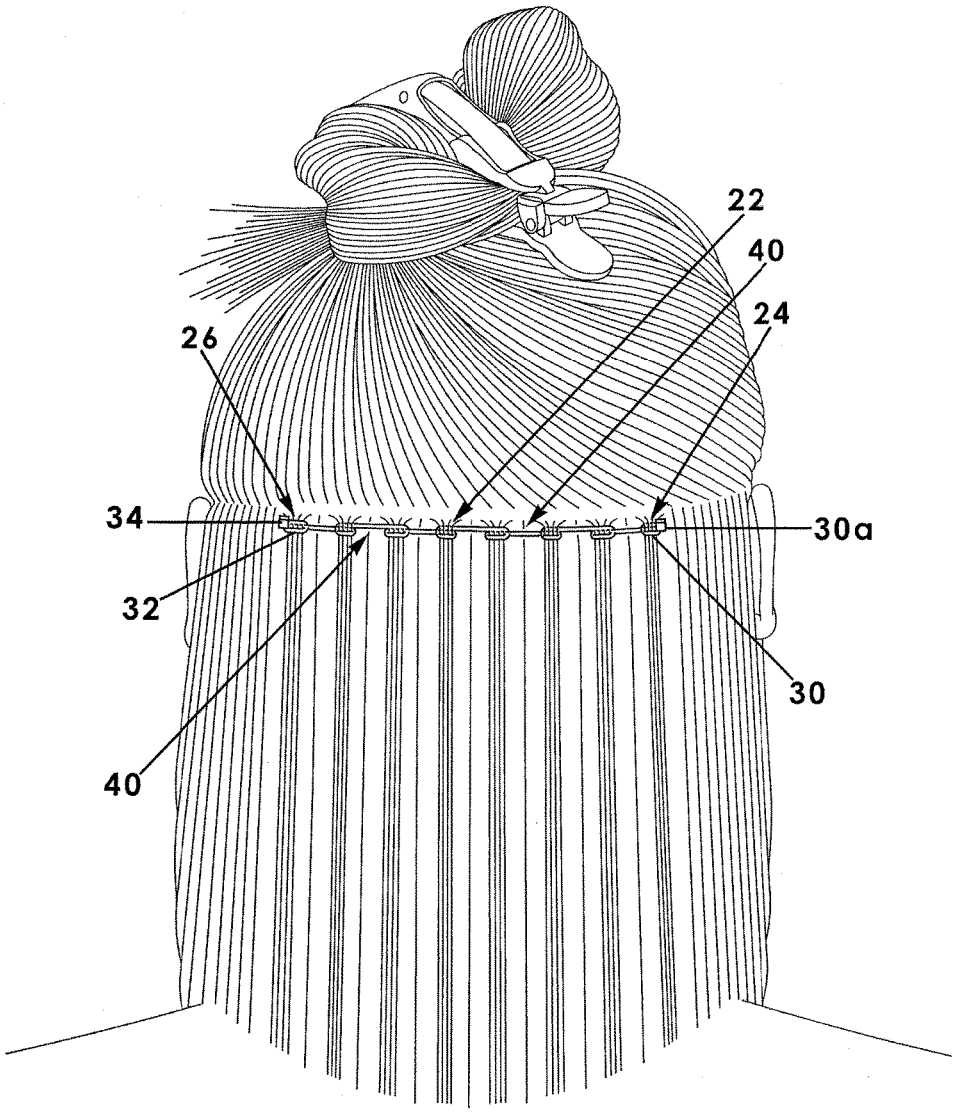
FIG. 10 is a rear view illustrating a foundation track completely formed according to the method of the present invention.
Figure 11:
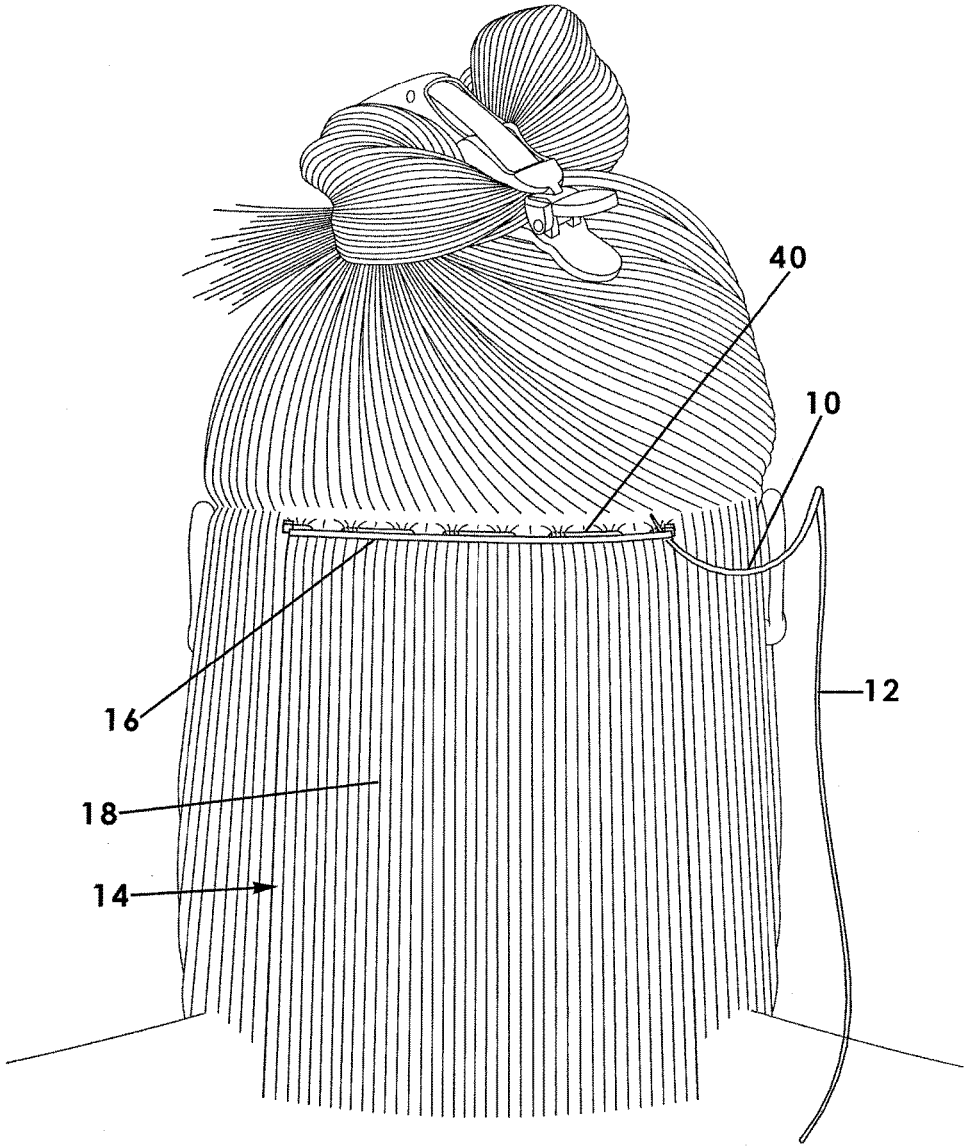
FIG. 11 is a rear view as in FIG. 10 illustrating a hair extension positioned for attachment to the foundation track.

The sew-in needle 10 may then be inserted beneath a next adjacent hair root section 22 such that the thread pair 12 is looped thereabout in a manner substantially similar to that described above and as shown in FIG. 7. This procedure may be repeated again and again relative to next adjacent hair root sections so as to form a foundation track 40 extending between said starter root section 24 and an ending root section 26 (FIG. 10). It is understood that the thread pair 12 may be pulled tightly about a respective hair root section 22 after each looping action or after several adjacent looping actions, so as to tighten the foundation track 40 to the person's scalp.

After the foundation track 40 has been formed by the looping steps relative to adjacent hair root sections 22 as described above, an ending knot 32 is formed by looping the thread pair 12 around an ending root section of natural hair. The ending knot 32 may be further secured to the foundation track 40 by securing it from unraveling. Specifically, an anchor link (which may also be referred to as a bead) may be coupled to the ending knot 32 by inserting the sew-in needle through the anchor link 34 and pulling the sew-in needle 10 and thread pair 12 through the ending knot 32. It is understood that the anchor link 34 is configured to prevent the ending knot 32 from unraveling. In addition, the anchor link 34 may be crimped or crushed, such as with needle nose pliers or the like, to prevent the anchor link 34 from moving or allowing said unraveling. In an embodiment, glue may be applied to the ending knot 32 to likewise prevent the ending knot 32 from loosening inadvertently. In still another embodiment, the silk thread wrapped around the end root section 26 may be melted with a heat gun—again, to prevent the ending knot 32 of thread from unraveling.

Figure 8A:
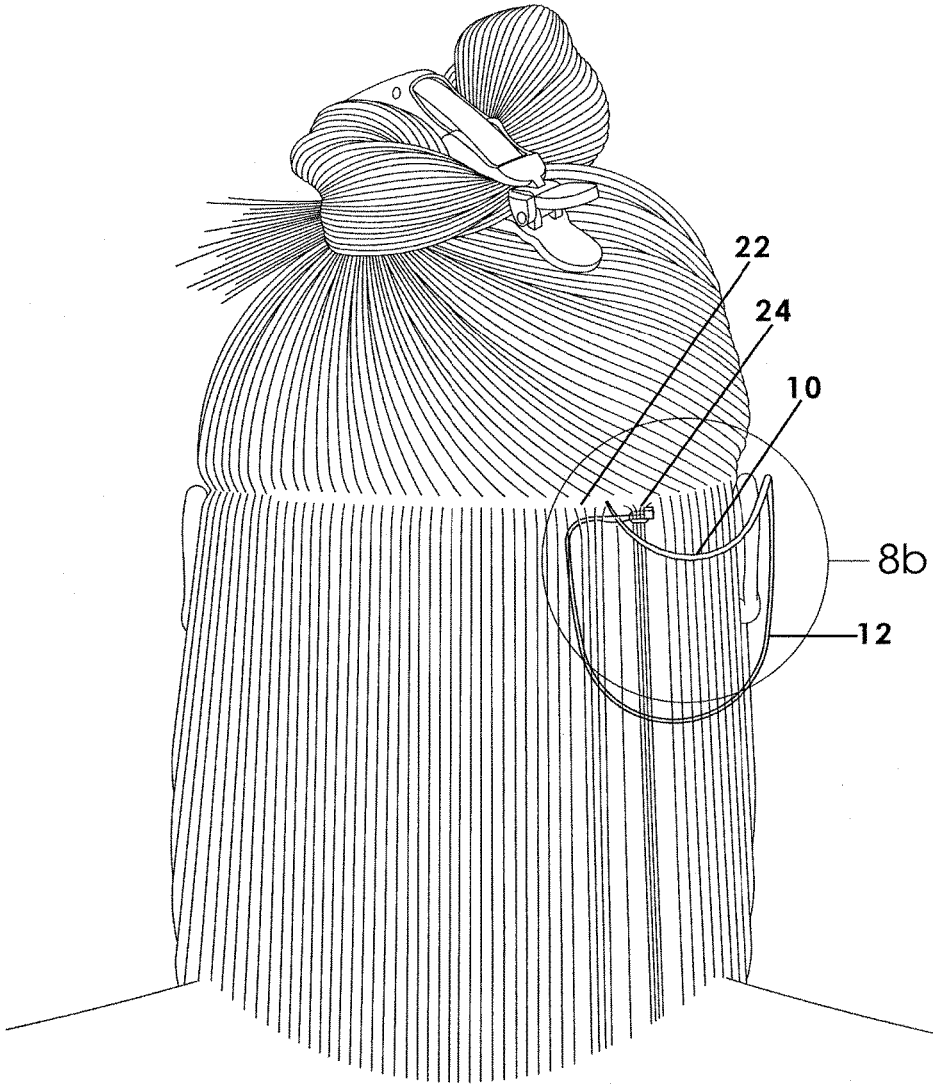
FIG. 8*a* is a rear view as in FIG. 7 illustrating forming an auxiliary knot.
Figure 8B:
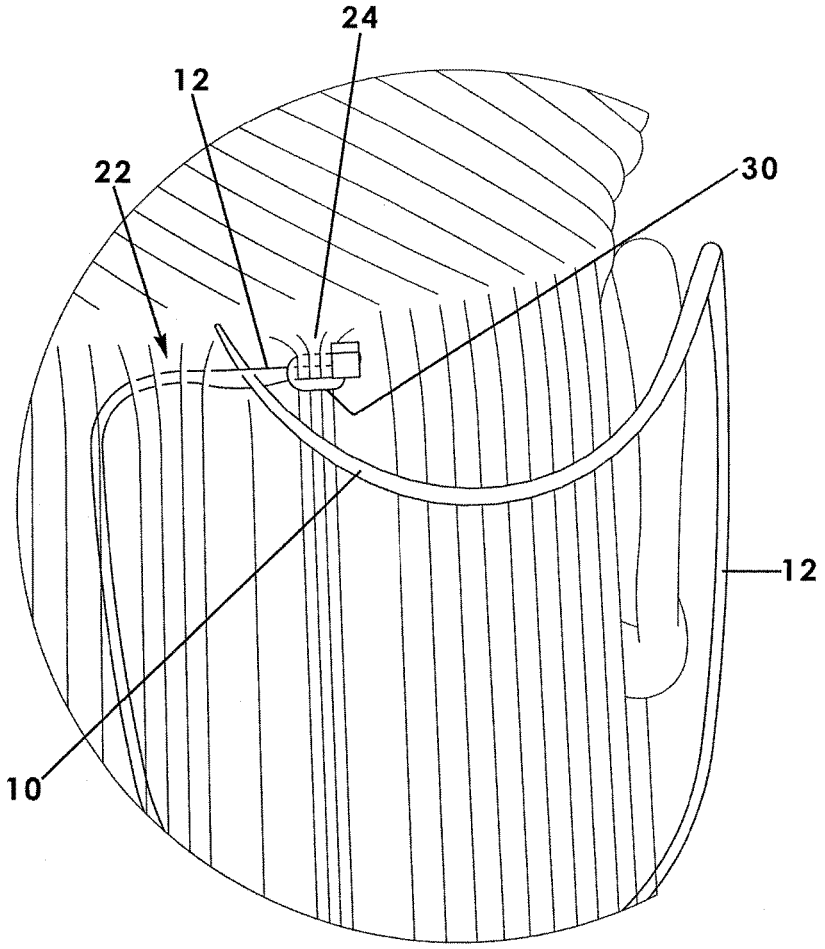
FIG. 8*b* is an isolated view on an enlarged scale taken from FIG. 8*a;*

In an embodiment, the thread pair 12 is directed to form an auxiliary knot at predetermined intervals along the foundation track 40 as it is being formed. More particularly, the sew-in needle 10 is inserted between the pair of threads of the thread pair 12 prior after looping the thread pair 12 about a respective hair root section and a next adjacent hair root section 22 (FIG. 8*b*). Preferably, an auxiliary knot is formed every other iteration of looping about a next adjacent hair root section although every third iteration would also work so as to enhance the strength of the foundation track 40.

Figure 12:
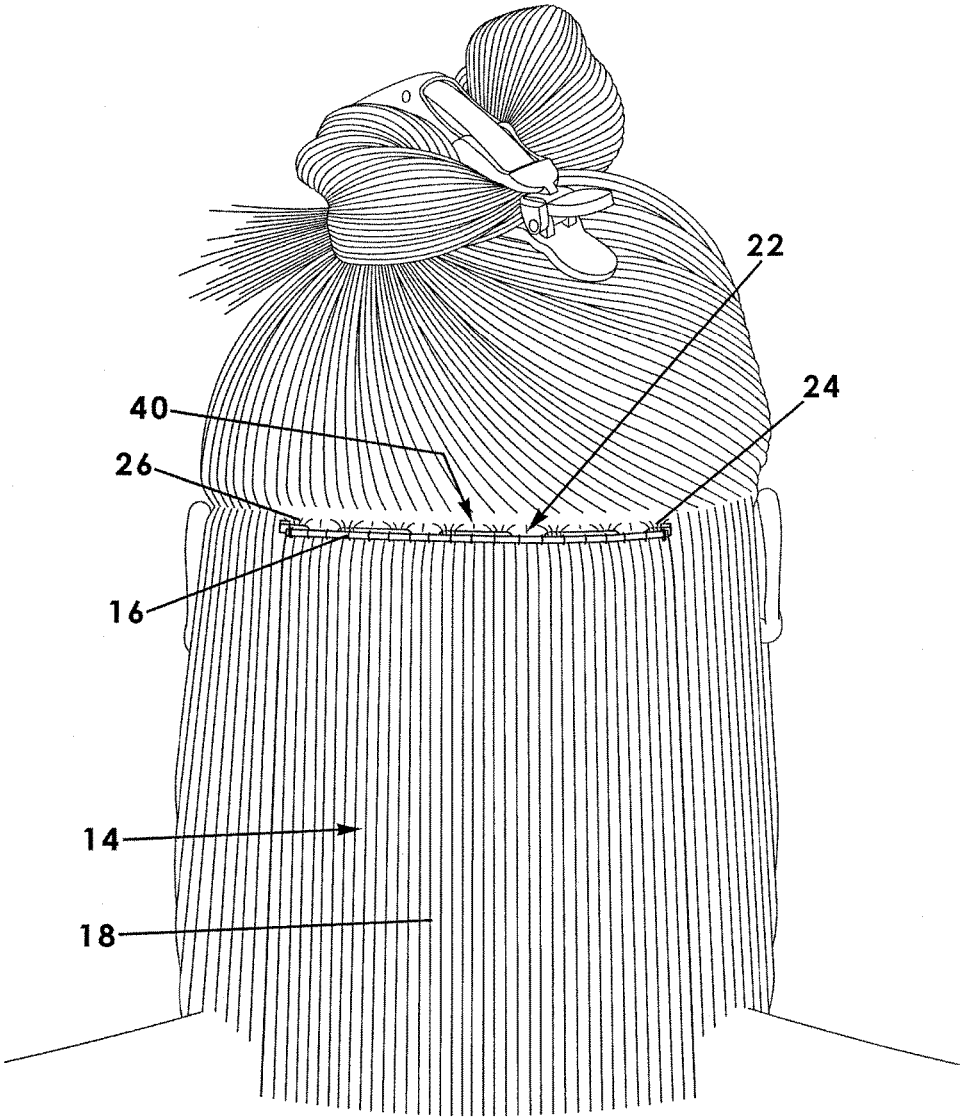
FIG. 12 is a rear view as in FIG. 11 illustrating the hair extension coupled to the foundation track.

Once the foundation track 40 is securely formed and positioned, the wefted hair extension 14 (also referred to as "the weft") may be sewn in to the person's natural hair so as to form a combination of artificial and natural hair. The weft may include a weave portion 16 along its upper edge and extending between opposed side edges. A plurality of strands of artificial hair 18 extends downwardly from the weave portion 16. The sew-in needle may be inserted through the weave portion 16 and then looped around the foundation track 40 so as to couple the two together. Repeating this step along substantially the entire foundation track 40 results in secure attachment of the hair extension 14 to the foundation track 40 (FIG. 10). An ending knot may be formed at a terminal edge of the hair extension 14 and the thread pair tied and cut there (FIG. 12).

In use, the method disclosed herein and illustrated in the accompanying drawings causes the transformation of a person's natural hair into a combination of natural hair and artificial hair.

It is understood that while certain forms of this invention have been illustrated and described, it is not limited thereto except insofar as such limitations are included in the following claims and allowable functional equivalents thereof.

The invention claimed is:

1. A method for forming a combination of natural and artificial hair on a person's head not having a braid foundation, comprising:

providing a wefted hair extension that includes artificial hair, a sew-in needle, and a thread pair coupled to and extending from said sew-in needle;

parting the person's natural hair so as to form a plurality of hair root sections contiguously adjacent one another along a part line;

forming a starter knot about a starter root section selected from said plurality of hair root sections by looping said thread pair about the starter root section using said sew-in needle;

creating a foundation track laterally across a person's head along said part line by repeatedly looping said thread pair around respective hair root sections between the starter root section and an ending root section;

forming an ending knot about the ending root section by looping said thread pair about the ending root section so as to secure said foundation track to the person's head; and sewing said wefted hair extension to said foundation track using said sew-in needle and said thread pair so as to form a combination of natural and artificial hair extending from the person's head;

wherein said wefted hair extension includes:

a weave portion adjacent an upper end thereof;

a plurality of strands of artificial hair extending downwardly from said weave portion and configured in a manner that simulates natural hair;

wherein said step of sewing said wefted hair extension to said foundation track includes the steps of:

extending said needle through said weave portion of said wefted hair extension and looping said thread pair about said foundation track; and repeating said step of extending said needle through said weave portion and looping said thread pair about said foundation track sequentially along said foundation track between said starter knot and said ending knot.

2. The method as in claim 1, wherein said thread pair is constructed of silk and includes a slip-resistant surface.

3. The method as in claim 1, wherein said step of forming said starter knot includes looping said thread pair about said starting root section using said sew-in needle at least two additional times before looping said thread pair about an adjacent root section so as to increase the strength and stability of said starter knot.

4. The method as in claim 1, further comprising the step of applying glue to said ending knot so as to prevent said ending knot from unraveling.

5. The method as in claim 1, further comprising the step of applying heat at a level capable of melting silk thread to said ending knot so as to prevent said ending knot from unraveling.

6. The method as in claim 1, further comprising the steps of:

extending said thread pair through an anchor link using said sew-in needle;

urging said anchor link into contact with said ending knot; and crimping said anchor link so as to prevent said ending knot from unraveling.

7. The method as in claim 1, wherein the step of repeatedly looping said thread pair around respective hair root sections between said starter root section and said ending root section includes the step of leading said sew-in needle between said thread pair prior to looping said thread pair about a respective hair root section every third repetition.

8. The method as in claim 1, further comprising the step of pulling the thread tightly after looping said thread pair about a respective hair root section so as to tighten the foundation track to the person's head.

9. The method as in claim 1, wherein:

said thread pair is constructed of silk and includes a slip-resistant surface;

said step of forming said starter knot includes looping said thread pair about said starting root section using said sew-in needle at least two additional times before looping said thread pair about an adjacent root section so as to increase the strength and stability of said starter knot;

said step of sewing said wefted hair extension to said foundation track includes the steps of:

extending said needle through said weave portion of said wefted hair extension and looping said thread pair about said foundation track; and repeating said step of extending said needle through said weave portion and looping said thread pair about said foundation track sequentially along said foundation track between said starter knot and said ending knot.

10. The method as in claim 9, further comprising the steps of:

extending said thread pair through an anchor link using said sew-in needle;

urging said anchor link into contact with said ending knot; and crimping said anchor link so as to prevent said ending knot from unraveling.

11. The method as in claim 10, wherein the step of repeatedly looping said thread pair around respective hair root sections between said starter root section and said ending root section includes the step of inserting said sew-in needle between respective threads of said thread pair prior to looping said thread pair about a respective hair root section every other repetition.

12. A method for forming a combination of natural and artificial hair on a person's head not having a braid foundation, comprising:

providing a wefted hair extension that includes artificial hair, a sew-in needle, and a thread pair coupled to and extending from said sew-in needle;

parting the person's natural hair so as to form a plurality of hair root sections contiguously adjacent one another along a part line;

forming a starter knot about a starter root section selected from said plurality of hair root sections by looping said thread pair about the starter root section using said sew-in needle;

creating a foundation track laterally across a person's head along said part line by repeatedly looping said thread pair around respective hair root sections between the starter root section and an ending root section;

forming an ending knot about the ending root section by looping said thread pair about the ending root section so as to secure said foundation track to the person's head;

sewing said wefted hair extension to said foundation track using said sew-in needle and said thread pair so as to form a combination of natural and artificial hair extending from the person's head;

wherein the step of repeatedly looping said thread pair around respective hair root sections between said starter root section and said ending root section includes the step of inserting said sew-in needle between respective threads of said thread pair prior to looping said thread pair about a respective hair root section every other repetition.

* * * * *